United States Patent [19]

Naevestad

[11] 4,115,203

[45] Sep. 19, 1978

[54] SEAL FOR COKE OVEN DOORS

[75] Inventor: Roy Naevestad, Fanwood, N.J.

[73] Assignee: Wilputte Corporation, New Providence, N.J.

[21] Appl. No.: 757,378

[22] Filed: Jan. 6, 1977

[51] Int. Cl.[2] ..... C10B 25/06; C10B 25/18

[52] U.S. Cl. ..... 202/248; 110/173 R

[58] Field of Search ..... 202/248; 110/173 R

[56] References Cited

U.S. PATENT DOCUMENTS

| | | | |
|---|---|---|---|
| 2,007,318 | 7/1935 | Wilhelm | 202/248 |
| 2,236,092 | 3/1941 | Freeman | 202/248 |
| 2,442,348 | 6/1948 | Exum | 202/248 |
| 3,505,174 | 4/1970 | Peterson et al. | 202/248 |
| 3,834,995 | 9/1974 | Van Ackeren | 202/248 |
| 3,974,038 | 8/1976 | Tucker | 202/248 |

*Primary Examiner*—Morris O. Wolk
*Assistant Examiner*—Roger F. Phillips
*Attorney, Agent, or Firm*—Buell, Blenko & Ziesenheim

[57] ABSTRACT

A knife edge type of sealing means for coke oven doors having edgewise flexibility permitting the knife edge strip to adjust inwardly and outwardly with respect to the plane of the seating surface of the door jamb as the door jamb warps under service conditions due to exposure to oven heat. A number of different forms are disclosed, in several of which the knife edge strip is made up of end-butting or overlapping sections jointed for relative expansive and contractive movement, the strip being tightly held in a transversely slotted retainer support of U-shape in cross-section, which is in turn sealingly secured to a flexible diaphragm member, of either of two forms, attached to the coke oven door. Another form of knife edge sealing strip is partially slotted from the inner edge outwardly while the U-shaped retainer member is expansively jointed. Another form of knife edge has a T-shaped cross-section with the web of the T partially slotted toward the base and joined across the slots by splicing plates expansively attached to the web. In another form, the retainer member of U-shape is diagonally slotted from the outer edge toward the base while the knife edge strip has the inner edge partially slotted outwardly at intervals along the length thereof.

9 Claims, 19 Drawing Figures

Figure 1:
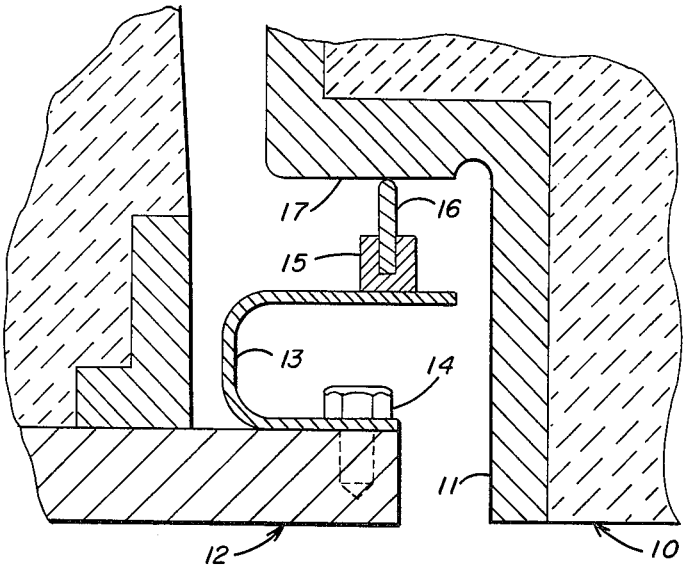

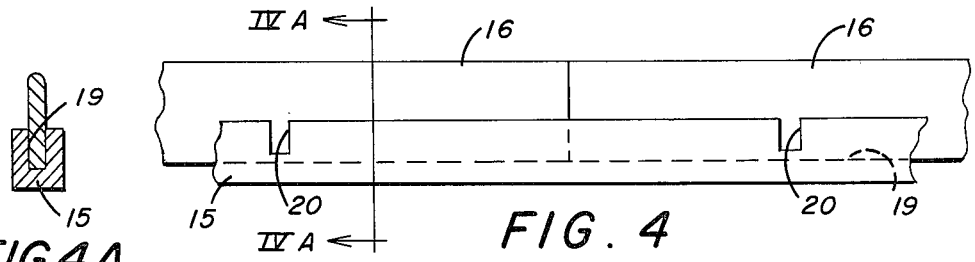
FIG. 4
FIG.4A
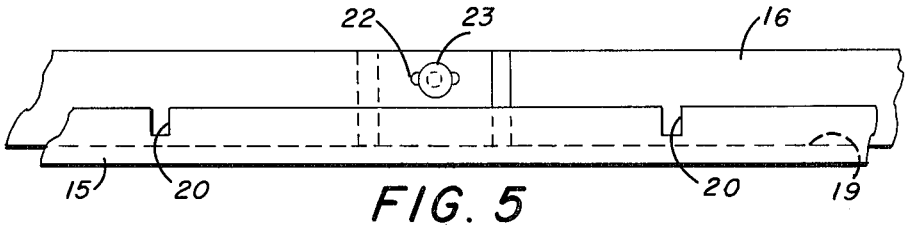
FIG. 5
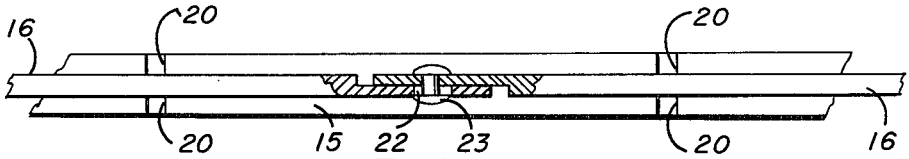
FIG. 6
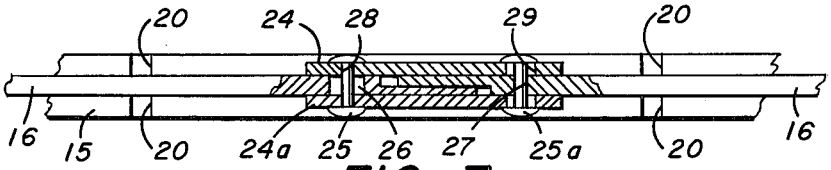
FIG. 7
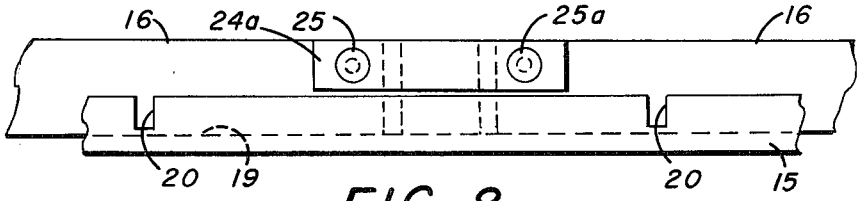
FIG. 8
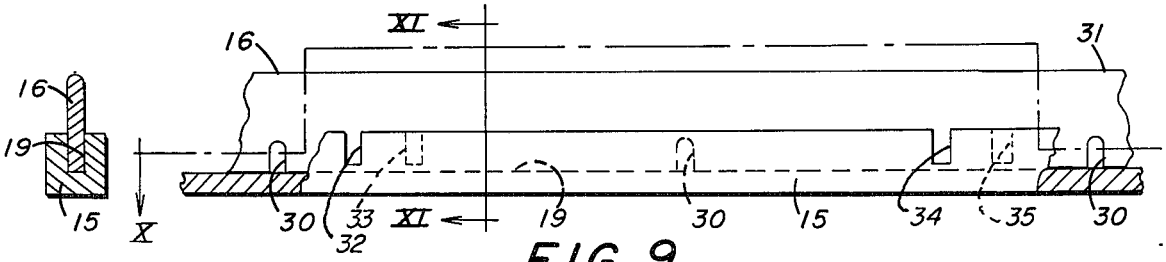
FIG. 9
FIG.11
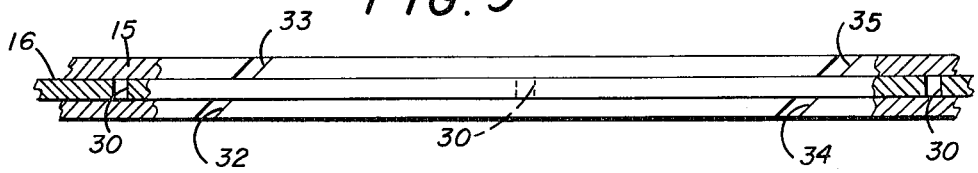
FIG. 10

SEAL FOR COKE OVEN DOORS

This invention relates to seals for coke oven doors of the type comprising a continuous knife edge flexible sealing strip attached to the oven door for engaging the surface of the door jamb in sealing relation.

Seals for coke oven doors of the knife edge type having a continuous sealing strip attached to the door and adapted to engage the surface of the door jamb when the door is moved into oven doorway closing position, are well known. In one form the knife edge strip is fixedly attached, as by screws, to the door frame, as shown in U.S. Pat. No. 2,698,289 issued Dec. 28, 1954. In another form, the knife edge is formed integrally with a flexible diaphragm member of U-shaped cross-section, as shown in U.S. Pat. No. 2,800,435, issued July 23, 1957. In another form, the knife edge is fixed to a part of the door which is resiliently attached to the door, as shown in U.S. Pat. No. 2,812,292.

Experience has revealed that the knife edge types of coke oven door seals which are in use today, leave something to be desired in that they do not retain the ability to follow the surface of the door jamb as it warps under the high-temperature conditions of service. In a publication PB-245-580 of Battelle Columbus Laboratories, dated July, 1975, reporting the results of a research project for the National Environmental Research Center and entitled "Study of Concepts for Minimizing Emissions From Coke-Oven Door Seals", it is stated that: "The major problems, however, are the bowing of the jambs and the inability of the various designs of seal-edge arrangements to accommodate themselves to jamb distortion, particularly inward jamb destortion". This publication analyzes the various known forms of seals for coke-oven doors in use today and makes certain proposals by which the seals may be improved.

It is the purpose of this invention to provide a seal for coke-oven doors of the knife edge type which provides a more effective seal than seals presently known, by reason of the fact that it is so constructed as to adjust to the warping of door jambs under service conditions, both inwardly and outwardly.

To attain this objective, I provide a number of embodiments of a knife edge type of coke-oven seal wherein the preferred form comprises a knife edge strip supported longitudinally in a retainer of U-shaped cross-section which is laterally slotted to provide flexibility and wherein the knife edge strip itself is formed in longitudinal end-butting or overlapping sections jointed to enable relative expansion and contraction of the adjacent sections.

I further provide another form of knife edge seal wherein the retainer is made up of expansively jointed longitudinal sections and the knife edge strip has its inner or back edge slotted outwardly.

I further provide another form of knife edge seal wherein the outer edges of the retainer are slotted diagonally at intervals along their length and the knife edge strip has its inner edge slotted outwardly.

I further provide another form of knife edge seal wherein the knife edge strip is of T-shaped cross-section, the web being partially slotted toward the base at intervals along its length and having expansively jointed splicing plates bridging the slots.

Figure 2:
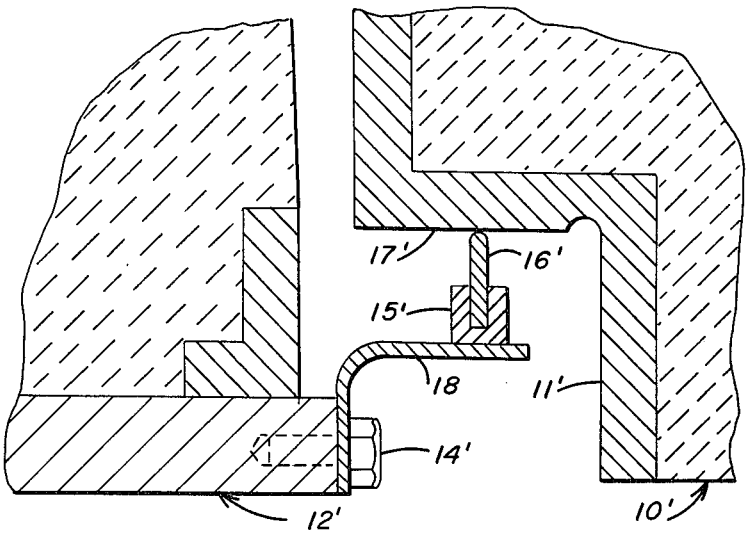
Figure 3:
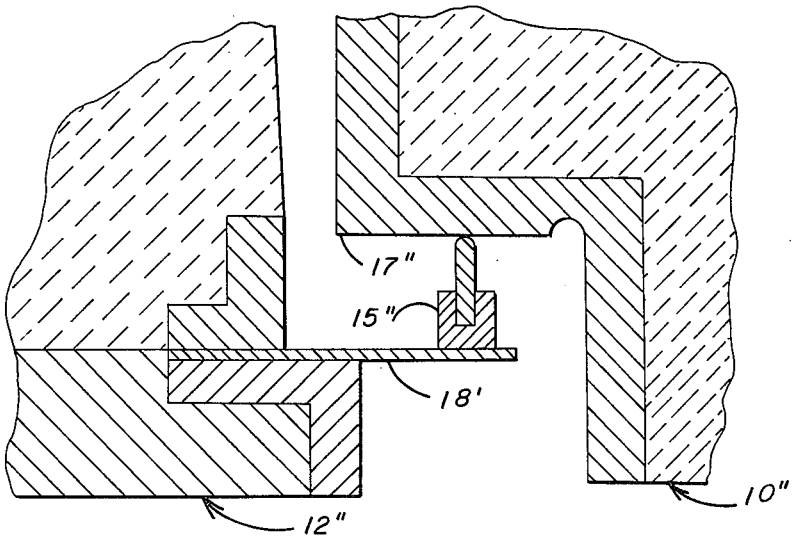
Figure 15:
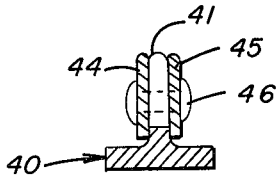
Figure 16:
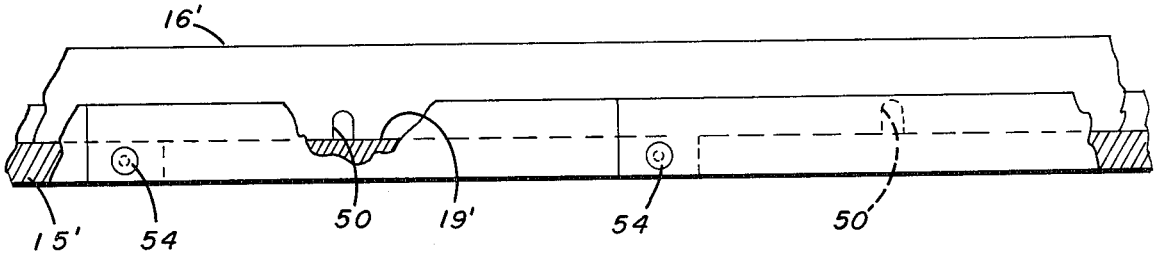
Figure 17:
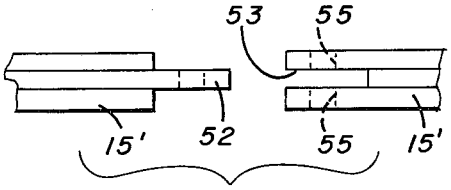
Figure 18:
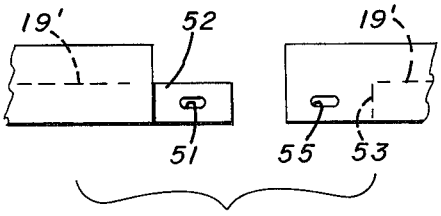

The various embodiments above described will be more fully described hereinafter in connection with the accompanying drawings wherein:

FIGS. 1, 2 and 3 show generally and fragmentally three different embodiments of closed loop diaphragm means whereby a resilient mounting is provided for various forms of knife edge seals, FIGS. 4 and 4A show a combination knife edge strip and U-shaped retainer embodying the basic principle of my invention, that of flexibility and expansibility of both knife edge strip and the retainer therefor, FIGS. 5 to 8 show variations of construction of a combined knife edge strip and U-retainer, wherein the knife edge strip is expansively jointed and the retainer is slotted, FIGS. 9 to 11 show another embodiment of combined knife edge strip and U-retainer in which both members are slotted, FIGS. 12 to 15 show another embodiment of knife edge strip having a T-shaped cross section in which the web of the T is partially slotted at intervals along its length and is expansively jointed by splicing plates bridging the slots, FIGS. 16 to 18 show another embodiment in which the U-shaped retainer is expansively and contractively jointed at intervals along its length and the knife edge strip has slots extending outwardly from its inner edge.

Referring to the drawings, FIGS. 1 and 2 show fragmentally a coke oven 10 having a doorway or jamb 11 and a door 12 which it moved into the opening formed by the jamb to effect closing of the doorway. In FIG. 1, the door 12 is shown as having a continuous or loop form of diaphragm 13, attached thereto along one edge as by a series of spaced bolts or screws 14. The diaphragm 13 is of U-shape in cross-section and a combined knife edge strip and retainer 15 is secured, as by welding to the free edge of the diaphragm. Thus, it will be seen that when the door 12 is fastened in its fixed closed position in the doorway, the knife edge strip 16 projecting out of retainer 15 sealingly engages the jamb surface 17 to seal the doorway closed. Obviously, the degree to which the diaphragm 13 is compressed in the closed position of the door determines the force with which the knife edge strip 16 is biasingly pressed to the door jamb surface 17.

Similarly, the diaphragm 18 shown in FIG. 2 is of L-shaped cross-section, one leg being secured to the door 12' as by a series of bolts or screws 14' and the free leg carrying thereon the combined knife edge strip and retainer 15'.

As in FIG. 1, the knife edge strip 16' is biased into sealing contact with the door jamb surface 17' depending on the degree to which the free leg of the diaphragm is stressed.

In FIG. 3, the diaphragm 18' is a continuous loop of flexible resilient steel plate or sheet, the inner area of which is confined between sections of the door 12'' and the outer area of which projects outwardly from the door. A combined knife edge strip and retainer 15'' is attached, as by welding, to the outer free area of the diaphragm with the knife edge strip oriented to engage the door jamb surface 17'' of the oven 10'' as the door 12'' moves toward its closed position.

It will be understood that the form of combined knife edge strip and retainer 15, 15' or 15'' shown in FIGS. 1, 2 and 3 is representative of the other embodiments of knife edge strip hereinafter described, which may be similarly attached to the diaphragms.

Referring now to FIGS. 4 and 4A, the embodiment of the combined knife edge strip and retainer shown in FIGS. 1, 2 and 3 will now be further described.

The embodiment shown in FIGS. 4 and 4A comprises a metallic retainer 15 of U-shape in cross-section and a series of sections of the flexible metallic strip 16 which are snugly or tightly fitted into the channel or groove 19 of the retainer. The ends of the strip sections are machined or ground to a sliding close fitting contact. The U-shaped retainer 15 is likewise machined or ground so that the side faces of the knife edge strip 16 fit into the channel 19 with a close but sliding fit. The side walls of the U-shaped retainer 15 are provided at intervals along the length thereof with slots 20 which terminate slightly short of the bottom of the groove or channel 19. It will be understood that the slots 20 are provided for the purpose of enabling the retainer to flex due to expansion or contraction thereof and thus enable the outer edge of the knife edge strip to follow the changes in contour of the jamb surface 17 due to warping which may occur during the heating or "coking" period of operation of the oven 10, and thus maintain a seal therewith. Since the slots 20 do not extend to the inner edge of the knife edge strip sections 16, no smoke or gases can by-pass the knife edge strip sections by flow under the sections. This is especially so because of the close fit between the knife edge strip sections and the walls of groove 19.

FIGS. 5 and 6 depict a variation of the embodiment shown in FIG. 4, wherein the sections of the knife edge strip 16 are recessed at the ends and seat in overlapped relation. As shown in FIG. 6, one of the overlapping end portions is provided with an oversized or slotted hole 22 through which a securing member, such as a rivet 23, extends. Thus the adjacent sections of knife edge strip 16 are enabled to adjust relative to each other, due to expansion or contraction, under service heat conditions of oven operation, for the purpose of following the changes in the jamb surface 17 due to warping. As in FIG. 4 the retainer 15 is provided with slots 20.

FIGS. 7 and 8 show another variation of the embodiment shown in FIG. 4, in which the ends of the adjacent sections of the knife edge strip 16 are recessed and seat in overlapping relation, as in FIGS. 5 and 6, but in which a pair of splicing plates 24 and 24*a*, narrower in width than the knife edge strip, are provided on opposite sides of the overlapping ends. The splicing plates are secured by a pair of rivets 25 and 25*a* which extend through corresponding holes 26 and 27 in the knife edge strip and 28 and 29 respectively in the splicing plates. The holes through the knife edge strip may both be oversized or slotted as shown for hole 26, or the holes through the knife edge strip may be close fitting while the holes 28 and 29 through the splicing plates may be oversized or slotted as shown for the hole 29. In either case, the connection between adjacent sections of the knife edge strip 16 effected by the splicing plates is such as to permit relative movement therebetween caused by expansion and contraction due to variations in heat from the oven.

FIGS. 9, 10 and 11 show another variation of the embodiment in FIG. 4, in which the knife edge strip 16 is continuous, that is not made up of separate sections connected through expansion joints, and in which the retainer 15 is continuous. As in FIG. 4, the groove 19 in the retainer is machined or ground to provide a tight but sliding fit between the knife edge strip 16 and the retainer 15.

In this embodiment the knife edge strip 16 is provided with slots 30 which extend outwardly and partially of the width the knife edge strip from the inner edge thereof. Slots 30 are shorter in length than the depth of the groove 19 in retainer 15. Thus, it is not possible for smoke, gases, etc. to pass through the slots 30 in by-pass of the outer sealing edge 31 of the knife edge strip 16.

The retainer 15 in this embodiment is diagonally slotted at intervals along its length as by slots 32, 33 and 34, 35 which stop short of the bottom of groove 19 in retainer 15. Thus, smoke, gases, etc. do not pass under the inner edge of the knife edge strip in by-pass of the outer sealing edge 31 of the knife edge strip 16.

It will be seen, therefore, that in this embodiment both the knife edge strip 16 and the retainer 15 are slotted to provide flexibility whereby they may expand or contract, with variations in heat conditions to follow the undulations or the warping of the jamb surfaces 17, 17'.

Referring now to FIGS. 12–15, another embodiment of somewhat different construction is shown. In this embodiment, a knife edge member 40, which is of inverted T-shape in cross-section, is attached to the diaphragms 13, 18 and 18' of FIGS. 1, 2 and 3 as by welding the base of the T thereto. The upright or web portion of the member 40 has narrow slots 41 therein, at intervals along the length thereof, the slots 41 extending inwardly from the outer sealing edge 42. As shown in FIG. 15, the slots 41 extend only part way into the web for a reason later explained.

Figure 12:
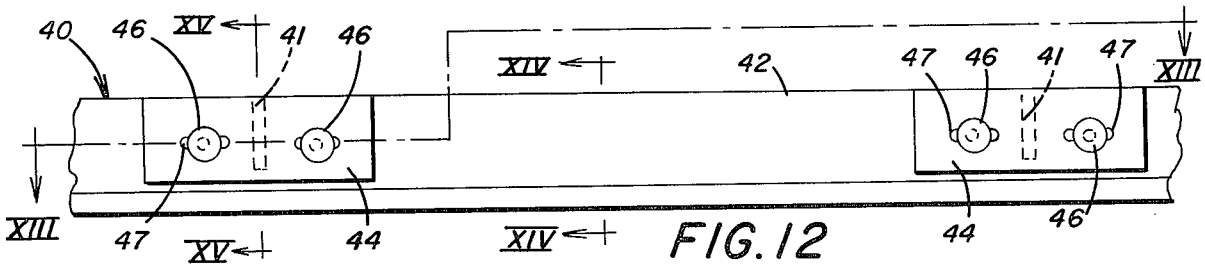
Figure 13:
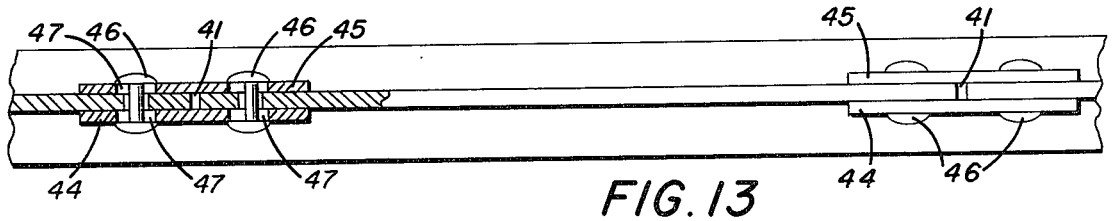
Figure 14:
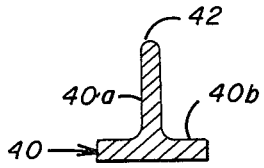

In order to maintain a rigidity of the knife edge strip, notwithstanding the slots 41, a pair of side plates 44, 45, are secured, as by a pair of rivets 46 in bridging relation to the slots 41 on opposite sides of the web of knife edge strip. As shown in FIGS. 12 and 13, the plates 44, 45 are provided with oversized or slotted holes 47, through which the rivets 46 extend which enables some flexibility in the web portion of the T-shaped knife edge strip to adjust to possible warping of the jamb surfaces 17, 17'.

It will be noted that due to the curved surface or radius at the juncture of the web 40*a* and base 40*b* of the member 40, the side plates are somewhat narrower in width than the height of the web 40*a*. Thus the inner edges of the side plates are spaced away from the base 40*b*. Moreover, the depth of the slots 41 is less than the width of the side plates 44, 45. It will be apparent, therefore, that the slots 41 are entirely covered by the side plates and no gas, smoke, etc. can escape through the slots in by-pass of the outer sealing edge 42 of the member 40, when seated on the jamb surfaces 17, 17' and 17''.

It will be noted that the outer edge of the side plates 44, 45 is rounded and in the plane of the sealing edge 42 of the member 40 so as to seat on the jamb surface 17. Thus, the slots 41 are further sealed against passage therethrough of smoke, gases, etc. from the interior of the oven in by-pass of the sealing edge 42.

Referring to FIGS. 16–18, a further embodiment is shown, which differs from those of FIGS. 5–8 in that (1) the knife edge strip 16' is a continuous strip (not made up in sections) with slots 50 extending outwardly from the inner edge and (2) the retainer is made up of a plurality of sections, the adjacent ends of adjoining sections being coupled together by a hinged joint. The base of the U-shaped retainer 15' is thicker than the base of retainer 15, as evident from FIG. 16, in order to provide sufficient space for a hole 51. As shown in FIGS. 17 and 18, the hinged joint is provided by an extension or tongue 52 of the base of one section of retainer 15' and a recess 53 in the base of an adjoining section. When the two sections are fitted together, a pin or rivet 54 is inserted through aligned holes 55 in the adjoining section and the hole 51 in the tongue 52 of the one section.

It will be noted that the depth of the slots 50 is less than the height of the side walls of retainer 15' above the floor or bottom of the groove 19'. Thus the slots 50 are completely covered by the side walls of retainer 15' and smoke, gases, etc. cannot flow through the slots in bypass of the sealing edge of the knife edge strip 16' when seated on the jamb surfaces 17, 17' or 17''.

It will be seen that various embodiments of knife edge strips are shown and described herein, all basically functioning to provide flexibility to the knife edge strip whereby it may provide an effective seal on the jamb surface of a coke oven doorway, notwithstanding undulations therein due to warping thereof. It will be seen that the embodiments shown are adapted for outward, as well as inward, flexing and thereby are effective to provide a seal against passage of smoke, gases, etc. from the interior of the coke oven in by-pass of the knife edge seal. It will be apparent that while specific embodiments have been described herein, modifications thereof are possible within the terms of the appended claims.

I claim:

1. In a coke oven door sealing means comprising a knife edge member and a retainer member having a groove in which said knife edge member snugly seats for relative movement with respect to said retainer member, the improvement wherein said knife edge member comprises a continuous element having transverse slots at intervals therein extending from the inner edge thereof part way toward the outer sealing edge thereof to provide edgewise bending flexibility thereof and wherein said retainer member comprises a continuous element having slots therein at intervals transversely intersecting said groove to provide bending flexibility thereof, the slots in said members being displaced whereby one of said members provides a seal against gas leakage via the slots in the other member.

2. In a coke oven door sealing means according to claim 1, the further improvement wherein the slots in said retainer member extend only partly of the depth of said groove and diagonally with respect to said groove.

3. In a coke oven door sealing means comprising a knife edge member and a continuous retainer member having a groove in which the knife edge member seats snugly, the improvement wherein said knife edge member comprises a plurality of separate longitudinal sections, the ends of adjacent sections being in tightly abutting contact, and the said retainer member has a plurality of longitudinally spaced slots transversely intersecting the said groove only partly of the depth of said groove.

4. In a coke oven door sealing means comprising a knife edge member and a continuous retainer member having a groove in which the knife edge member seats snugly, the improvement wherein said knife edge member comprises a plurality of sections of flexible metal strips of uniform thickness, the ends of adjacent sections being recessed and disposed in overlapping relation, wherein means adjustably joins said overlapping ends of adjacent sections in hinged relation and wherein said retainer member has a plurality of longitudinally spaced slots therein intersecting said groove and in displaced relation to said overlapping ends of the flexible metal strips.

5. A coke oven door sealing means according to claim 4, wherein the said means adjustably joining the overlapping ends of adjacent sections of flexible metal strips in hinged relation comprises metal splicing plates disposed on opposite sides of the overlapping portions of the metal strips, and a pair of spaced rivets secures the splicing plates to each other via the metal strips, with at least one of said sections having an elongated slot therein through which one of said rivets extends.

6. Coke oven door sealing means comprising a continuous metal strip of inverted T-shape in cross-section having a web portion and a base portion at a right angle to each other, the web portion of said metal strip having longitudinally spaced slots therein extending from the outer edge thereof partly toward the base, a pair of splicing plates on opposite sides respectively of the web portion in bridging relation to said slots, and a pair of rivets for securing said plates together via the web portion of the metal strip, said plates having oversized holes through which the rivets extend.

7. Coke oven door sealing means according to claim 6, wherein each of said splicing plates has a rounded outer edge flush with the outer edge of the web portion, and wherein the inner edge of each of the splicing plates is spaced from the base of the metal strip.

8. In a coke oven door sealing means comprising a knife edge member and a retainer member having a groove corresponding closely in width to the thickness of said knife edge member in which said knife edge member slidably seats, the improvement wherein said knife edge member comprises a flat continuous element of relatively little edgewise flexibility having a plurality of longitudinally spaced slots extending outwardly from the inner edge of said element partly to the outer edge thereof at intervals therein to provide an edgewise bending flexibility thereof and said retainer member has overlapping joint means therein at intervals to provide an edgewise bending flexibility thereof, said longitudinally spaced slots in said knife edge member being overlapped by said retainer member to provide a seal against gas leakage via said slots.

9. In a coke oven door sealing means comprising a knife edge member and a retainer member having a groove corresponding closely in width to the thickness of said knife edge member in which said knife edge member slidably seats, the improvement wherein said knife edge member comprises a flat continuous element of relatively little edgewise flexibility having a plurality of overlapping hinged joints at intervals therein to provide an edgewise bending flexibility thereof and said retainer member has a plurality of slots transversely intersecting said groove part way from the outer end of the groove toward the inner end of the groove to provide an edgewise flexibility of said retainer member, said slots being overlapped by said knife edge member to provide a seal against gas leakage via said slots.

* * * * *